US006354534B1

(12) United States Patent
Matsunagana et al.

(10) Patent No.: US 6,354,534 B1
(45) Date of Patent: Mar. 12, 2002

(54) MECHANISM FOR INCREASING THE DIAMETER OF METAL COIL COILERS

(75) Inventors: Douglas Matsunagana, Schiller Park; Esteban Lopez, Chicago, both of IL (US)

(73) Assignee: Braner USA, Inc., Schiller Park, IL (US)

( * ) Notice: Subject to any disclaimer, the term of this patent is extended or adjusted under 35 U.S.C. 154(b) by 0 days.

(21) Appl. No.: 09/550,664

(22) Filed: Apr. 17, 2000

Related U.S. Application Data

(63) Continuation-in-part of application No. 09/186,749, filed on Nov. 5, 1998, now abandoned.

(51) Int. Cl.[7] ..... B65H 75/24
(52) U.S. Cl. ..... 242/571; 242/575
(58) Field of Search ..... 242/571, 573.8, 242/575, 575.1, 575.2, 575.4

(56) References Cited

U.S. PATENT DOCUMENTS

| | | | | |
|---|---|---|---|---|
| 2,848,176 A | 8/1958 | Gunter | ..... | 242/575.1 |
| 3,396,918 A | 8/1968 | Adamson et al. | ..... | 242/571 |
| 3,815,840 A | 6/1974 | Horton et al. | ..... | 242/571 |
| 4,199,116 A | 4/1980 | Matsunaga | | |
| 4,201,352 A | 5/1980 | Madachy | ..... | 242/573.8 |
| 4,421,283 A | 12/1983 | Rippin | ..... | 242/573.8 |
| 5,904,315 A | 5/1999 | McInerney | ..... | 242/571 |

*Primary Examiner*—John M. Jillions
(74) *Attorney, Agent, or Firm*—James D. Hall; Ken C. Decker

(57) ABSTRACT

A recoiler/uncoiler for use in a line processing sheet material includes a segmented drum that is expandable from a contracted position to an expanded position. To enable the drum to accommodate coils of sheet material having different internal diameters, a sleeve consisting of sleeve segments which match the segments of the drum is installed on the drum and is expandable and contractible therewith. A cradle moved by a coil cart is transportable to a position circumscribing the sleeve. The cradle includes magnets which hold the sleeve in the expanded position after the sleeve is disengaged from the drum, to thereby permit removal of the sleeve. When the sleeve is reinstalled on the drum, the cradle transports the sleeve to its position circumscribing the drum, the drum is then expanded, and the sleeve is secured to the drum, whereupon the cradle is transported away from the drum and sleeve.

22 Claims, 12 Drawing Sheets

MECHANISM FOR INCREASING THE DIAMETER OF METAL COIL COILERS

This application is a Continuation-In-Part of U.S. patent application Ser. No. 09/186,749 filed Nov. 5, 1998 now abandoned.

BACKGROUND OF THE INVENTION

1. Field of the Invention

This invention relates to uncoilers and recoilers used in a line for processing sheet material, such as slitting lines used for dividing sheet steel.

2. Review of the Prior Art

Sheet steel is normally provided in coils, and it is common to process such material in a slitting line to divide the material longitudinally. A coil of un-slit sheet steel is placed on an uncoiler on one end of the line, and the steel is unwound from the coil and slit in the slitting line and then rolled into coils on a recoiler at the other end of the line. As used herein, the term "coiler" generally refers to either uncoilers or recoilers. Both uncoilers and recoilers include a drum having one end of which is rotatably mounted on a fixed support. The opposite end of the coil is free so that the coiled sheet steel can be installed on the drum of an uncoiler and removed from the drum of the recoiler. To facilitate installation and removal of the coils, the drums are expandable/contractible as set forth in U.S. Pat. No. 4,199,116. Sheet steel is normally wound into coils, which may have either of two standard inner diameters, and while the coilers have expanding mandrels to grip the inner coil opening, the expansion of the mandrels cannot accommodate the dimensional variance in inner diameters of the two standard diameters. The strips of slit steel may be wound on the recoiler into coils having either of the two common inner diameters. The coils with the smaller inner diameter may be placed directly upon, or removed from, the drum of the uncoiler or recoiler, but the coils with the larger inner diameter require that the drum be modified to have a larger outer diameter in order that the slit steel can be taken up.

There are a number of prior art methods which have been attempted, but which are inefficient for this use. Prior art adapter plates are used which are connected to the mandrel, but these are difficult and time consuming to install on the drums. To install adapter plates on the drum, the slitting line must be shut down, thereby losing production. In other versions, bands of rubber are wrapped around the mandrel which expand with the mandrel. These versions are extremely difficult, and become oil soaked after a short period of time, making them difficult to use. Another version is shown in U.S. Pat. No. 5,904,315 which shows movable elements which are surrounded by a polyurethane slit sleeve which is held on by elastic bands. Such a device would not be usable with a steel coil of the nature anticipated in the present invention.

It should be understood to those skilled in the art, the resultant inefficiency the prior art methods provide. In a fabrication facility of the type described, it is not uncommon to have a changeover in diameters three to four times per day, where the down time is nearly 40 minutes per changeover, primarily due to the mandrel diameter modification on the coiler.

According to the present invention, a sleeve having three interconnected segments is mounted on a drum having expandable segments in radial alignment with the segments of the drum, to permit the sleeve to be expanded and contracted with the drum.

The sleeve is installed and removed from the drum by way of a coil cart which is normally used to transport steel coils to and from the drum. Accordingly, the sleeve can quickly and easily be modified to accommodate coils having inner diameters of different sizes.

DESCRIPTION OF THE DRAWINGS

These and other advantages of the present invention will become apparent from the following description, with reference to the accompanying drawings, in which.

DETAILED DESCRIPTION OF THE PREFERRED EMBODIMENT

Figure 1:
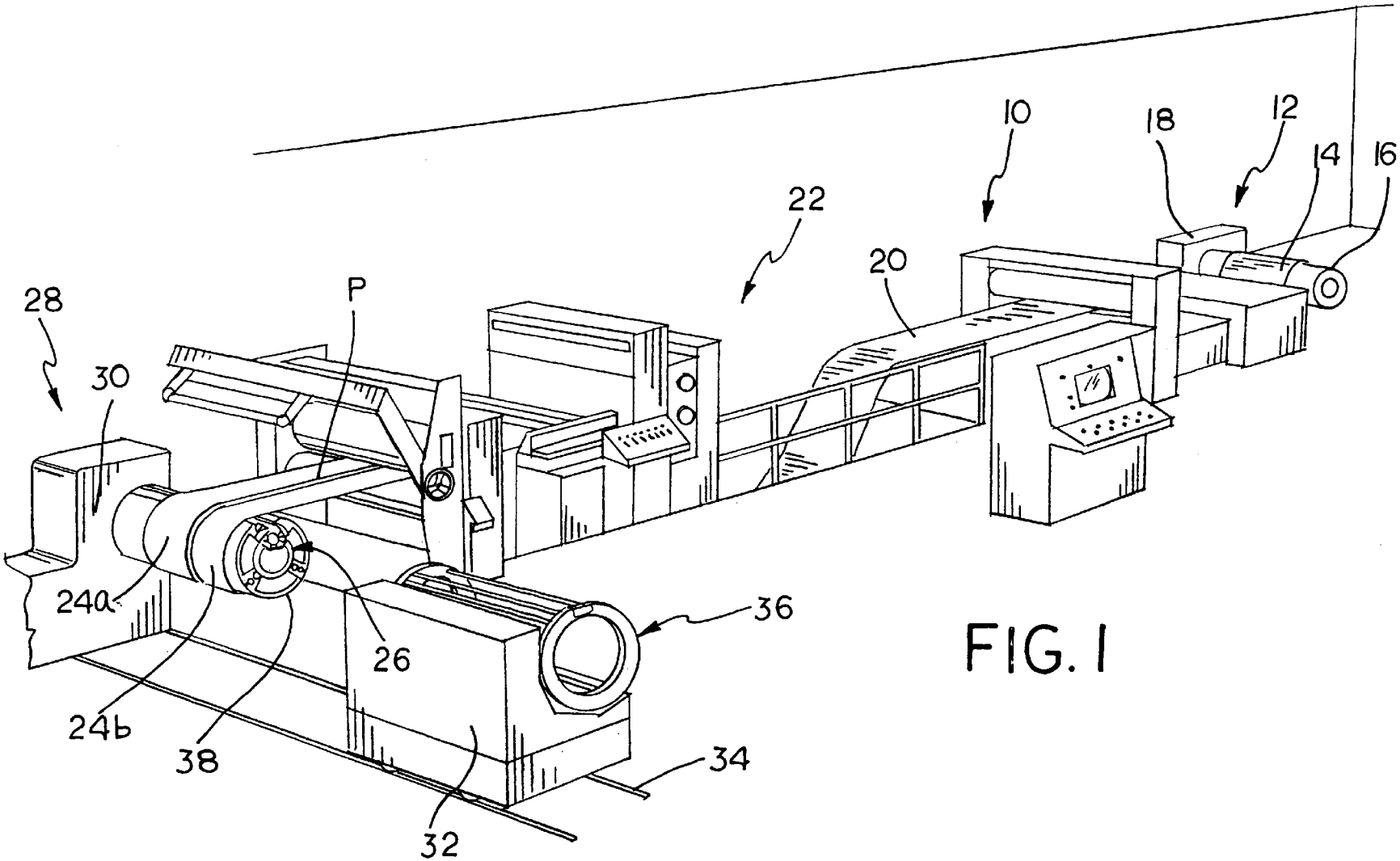
FIG. 1 is a view in perspective of a slitting line incorporating both an uncoiler and a recoiler made pursuant to the teachings of the present invention.

As described herein, the term coiler refers to both an uncoiler and recoiler, as the invention is equally applicable to both. Referring now to the drawings, a sheet steel slitting line generally indicated by the numeral 10 includes an uncoiler 12 upon which a coil 14 of sheet steel is supported on drum 16, which is rotatably supported on fixed support 18. The steel strip 20 unwound from the coil 14 is processed by conventional slitting equipment generally indicated by the numeral 22 to divide the steel strip 20 longitudinally, so that two separate coils of steel 24*a*, 24*b* are wound on drum 26 of recoiler generally indicated by the numeral 28. Drum 26 is mounted for rotation relative to conventional fixed support 30. A coil cart generally indicated by the numeral 32 is powered for movement along tracks 34, which extend generally transversely to the material pass line P of the slitting equipment 22. The material pass line P is the center line along which the steel strip 20 moves through the slitting equipment 22 and is wound on drum 26. Coil cart 32 is conventionally used for transporting the coils 24*a*, 24*b* away from the recoiler 28. A similar cart (not shown) may be used to transport the coils 14 to the uncoiler 12. As illustrated in FIG. 1, a cradle 36 is mounted on the coil cart 32 for movement toward and away from the recoiler 28 and, as will hereinafter be described, cradle 36 is used to support a sleeve 38 according to the present invention, to move the sleeve 38 between an active position mounted on the drum 26 and an inactive position displaced from the drum 26 to permit the drum 26 to roll coils 24*a*, 24*b* having a greater inner diameter when the sleeve 38 is installed on the drum and a lesser inner diameter when the sleeve is removed from the drum.

Figure 4:
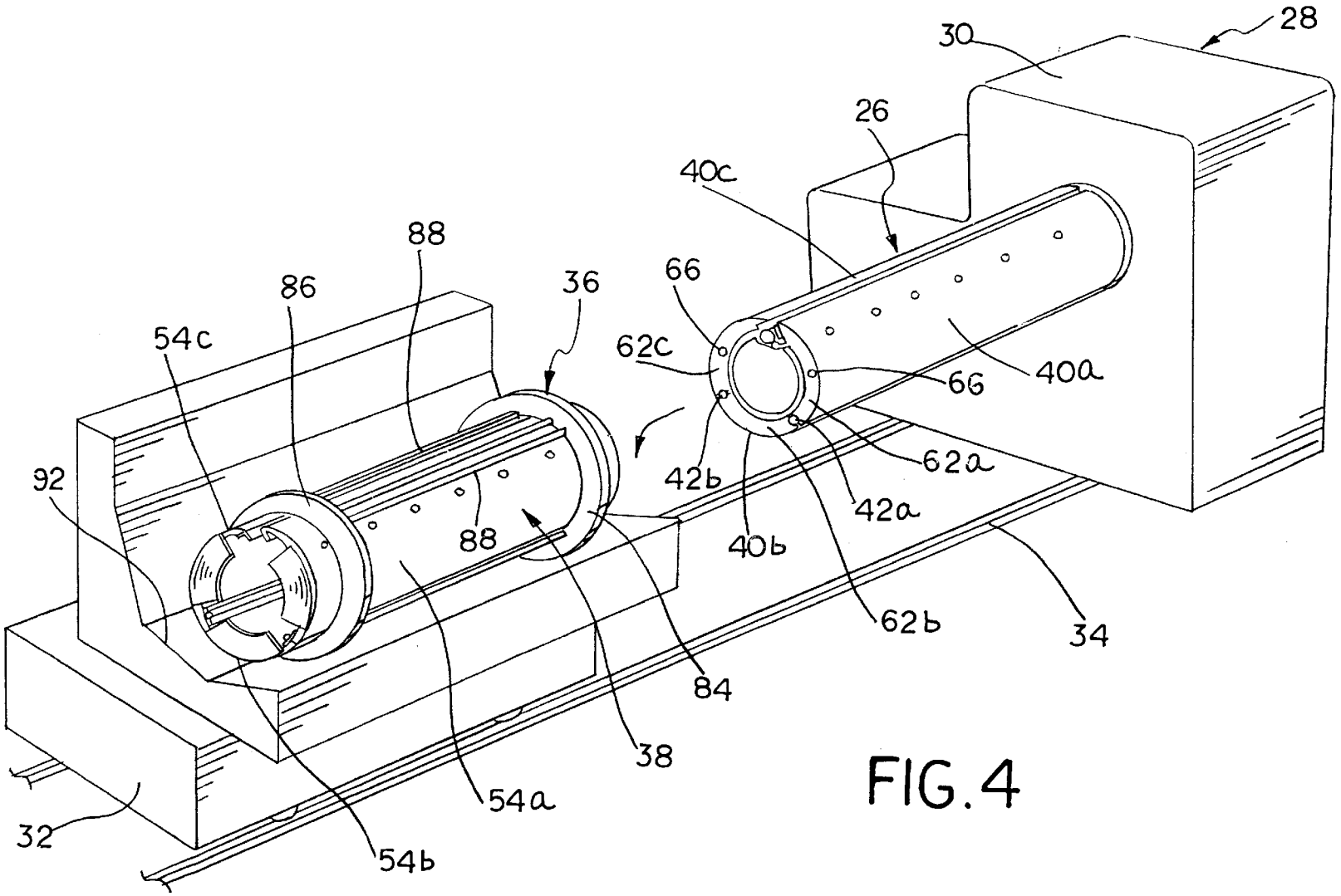
FIG. 4 is a view similar to FIG. 2, but illustrating the sleeve supported in the cradle and removed from the recoiler drum.
Figure 5:
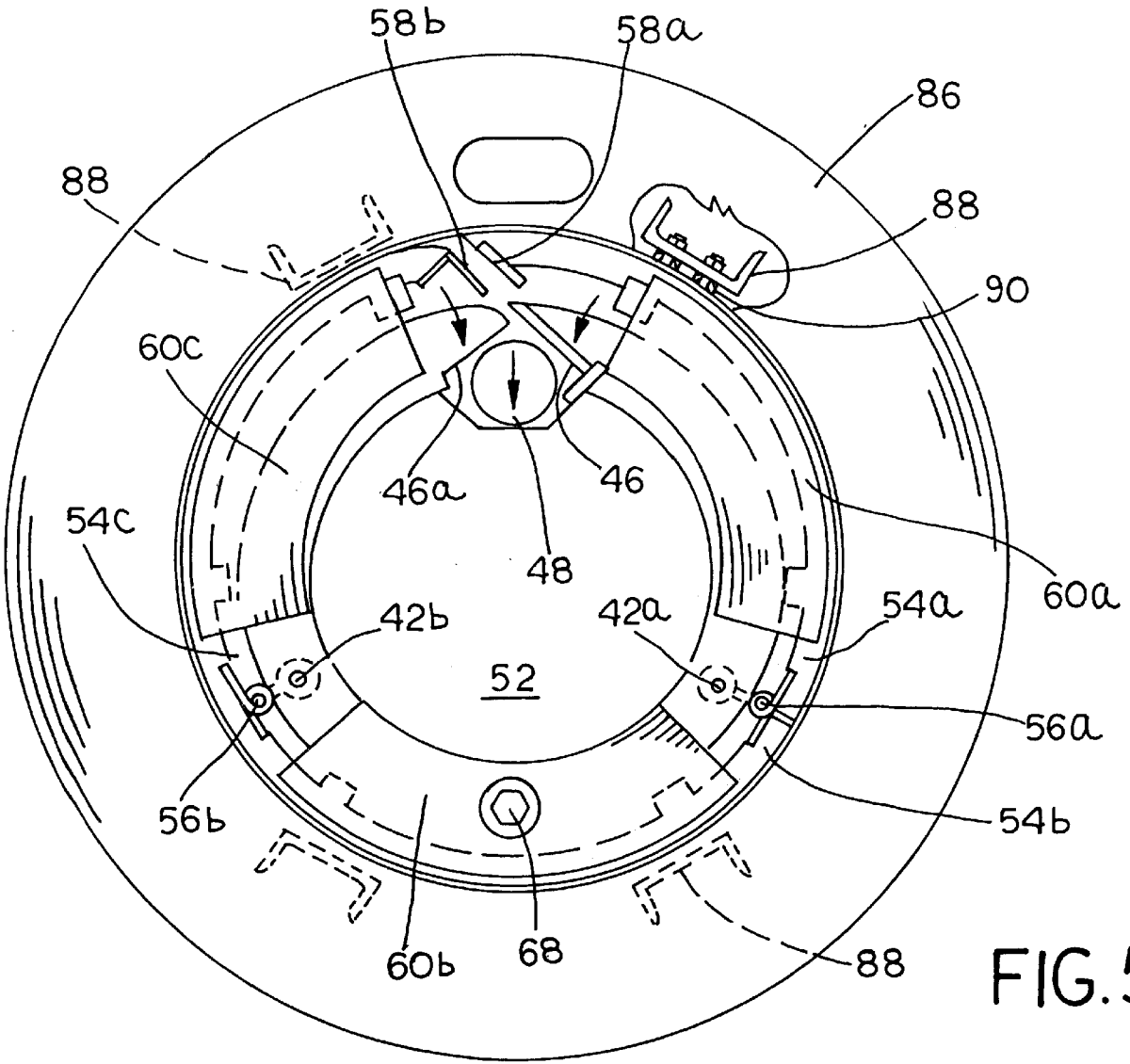
FIG. 5 is a end view of the recoiler drum, sleeve and cradle in which the cradle and sleeve are mounted on the drum as illustrated in FIG. 3.
Figure 6:
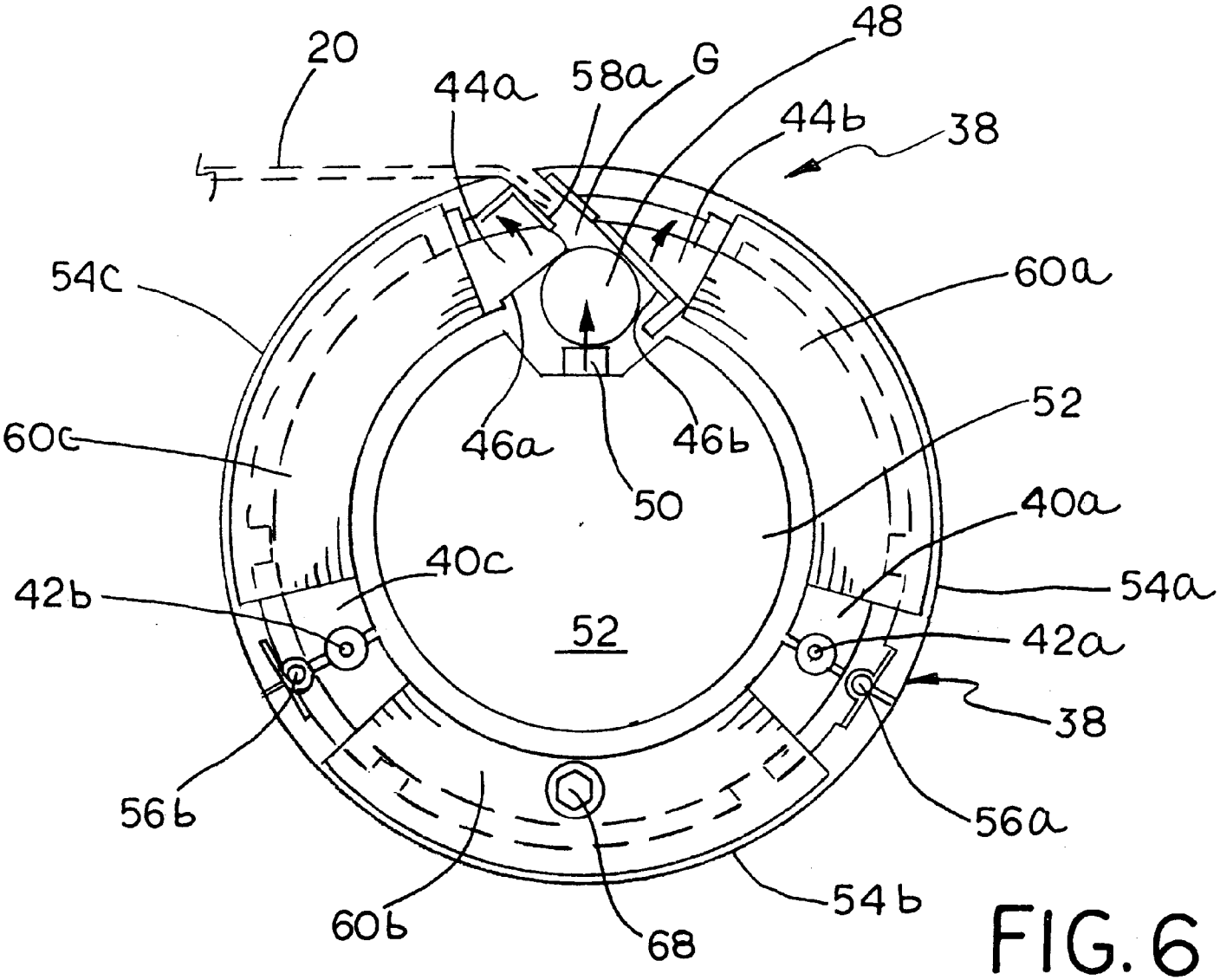
FIG. 6 is a view similar to FIG. 5, but illustrating the sleeve mounted on the drum with the cradle removed.

As shown best in FIGS. 4–6, the drum 26 is conventional and consists of three arcuate segments 40*a*, 40*b*, 40*c*, segment 40*a* being pivotably interconnected with segment 40*b* via a hinge 42*a*, and segments 40*b* and 40*c* being interconnected by a hinge 42*b*. Segments 40*a*, 40*c* terminate in contiguous ends 44*a*, 44*b* opposite their ends that are hingably connected to the segment 40*b*. Ends 44*a*, 44*b* cooperate to define a gap G (FIG. 6) into which the end of the sheet steel 20 is inserted. As shown in FIG. 6, contiguous ends 44*a*, 44*b* cooperate to define camming surfaces 46*a*, 46*b* which are engaged by a camming member 48 which is thrust outwardly, and retracted inwardly, by an actuating plunger 50. Actuating plunger 50 is slidably mounted within core 52 of the drum 26 around which the drum segments 40*a*–40*c* are mounted. Sleeve 38 includes segments 54*a*, 54*b*, and 54*c*, segments 54*a* and 54*b* being interconnected by a hinge 56*a* and the segments 54*b* and 54*c* being interconnected by a hinge 56*b*. It will be noted that the hinge 56*a* is radially aligned with hinge 42*a* and hinge 56*b* is radially aligned with the hinge 42*b* such that the sleeve segments 54*a*–54*c* expand and contract with the drum segments 40*a*–40*c*. The sleeve segments 54*a*, 54*c* define contiguous ends 58*a*, 58*b*, which cooperate with contiguous ends 44*a*, 44*b* for a continuation of the gap G.

Each of the sleeve segments 54*a*–54*c* include a radially inwardly projecting, circumferentially extending front adapter plate 60*a*, 60*b*, 60*c*, which extend from the outer end of the corresponding sleeve segment and over corresponding end faces 62*a*, 62*b*, 62*c* of the arcuate drum segments 40*a*–40*c*. The front adapter plates 60*a* and 60*c* are each provided with a pin 64 (FIG. 7) which is received in a corresponding aperture 66 when the sleeve is installed on the drum. A jack bolt 68 extends through the front adapter plate 60*b* and threadably engages threaded aperture 70 of the arcuate drum segment 40*b* when the sleeve is installed on the drum. The jack bolt 68 defines a shoulder 74 which is received within a recess 72 in the front adapter plate 60*b* which faces the end face 62*b* of the drum 26. The recess 72 terminates in an end face 76 which is engaged by the shoulder 74 when the jack bolt 68 is rotated in a direction withdrawing the jack bolt from the threaded aperture 70, to assist in removing the sleeve 38 from the drum 26 as will hereinafter be explained.

Figure 7:
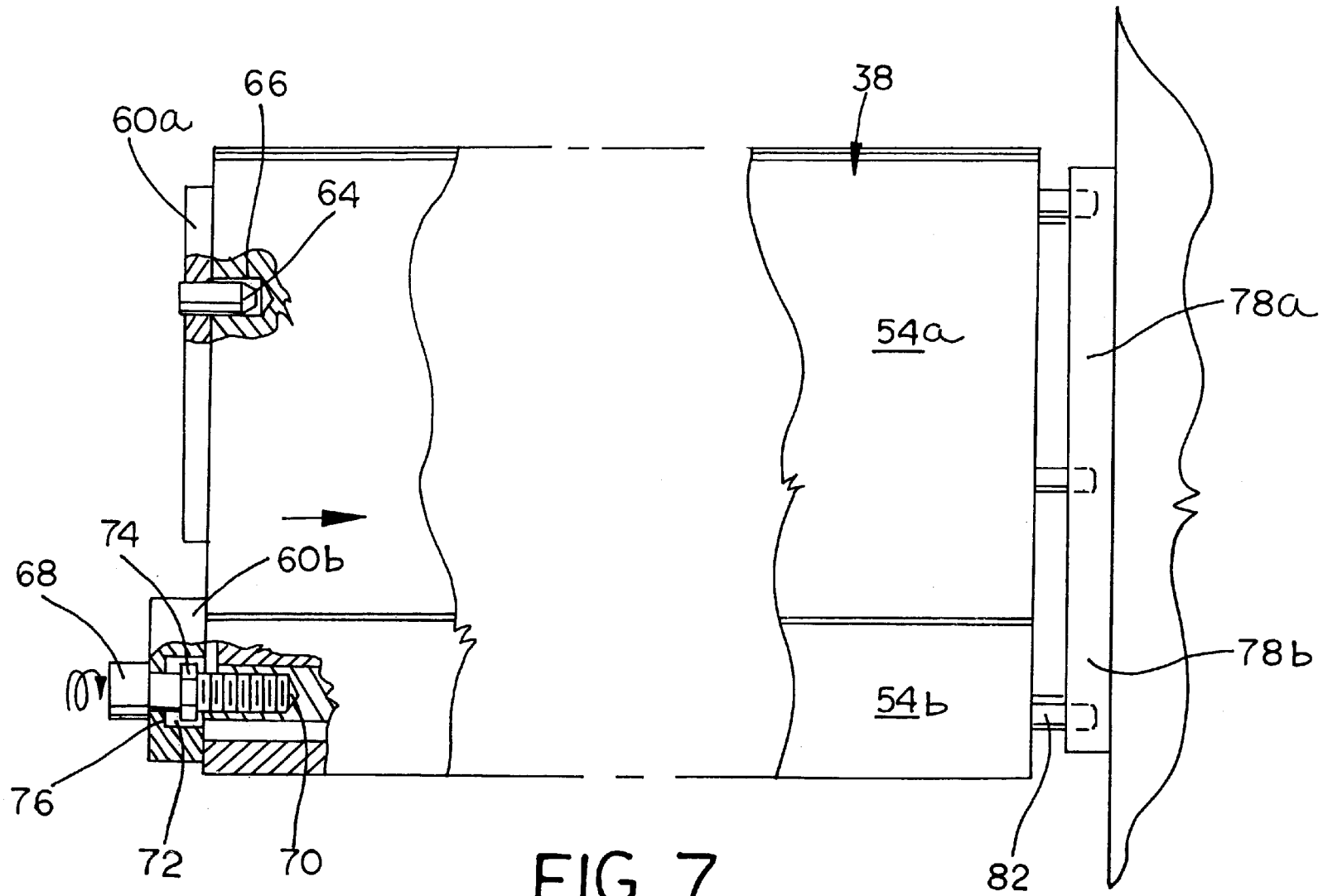
FIG. 7 is a side elevational view, partly in section, of the recoiler drum illustrated in FIGS. 1-6 with the sleeve installed thereon.
Figure 8:
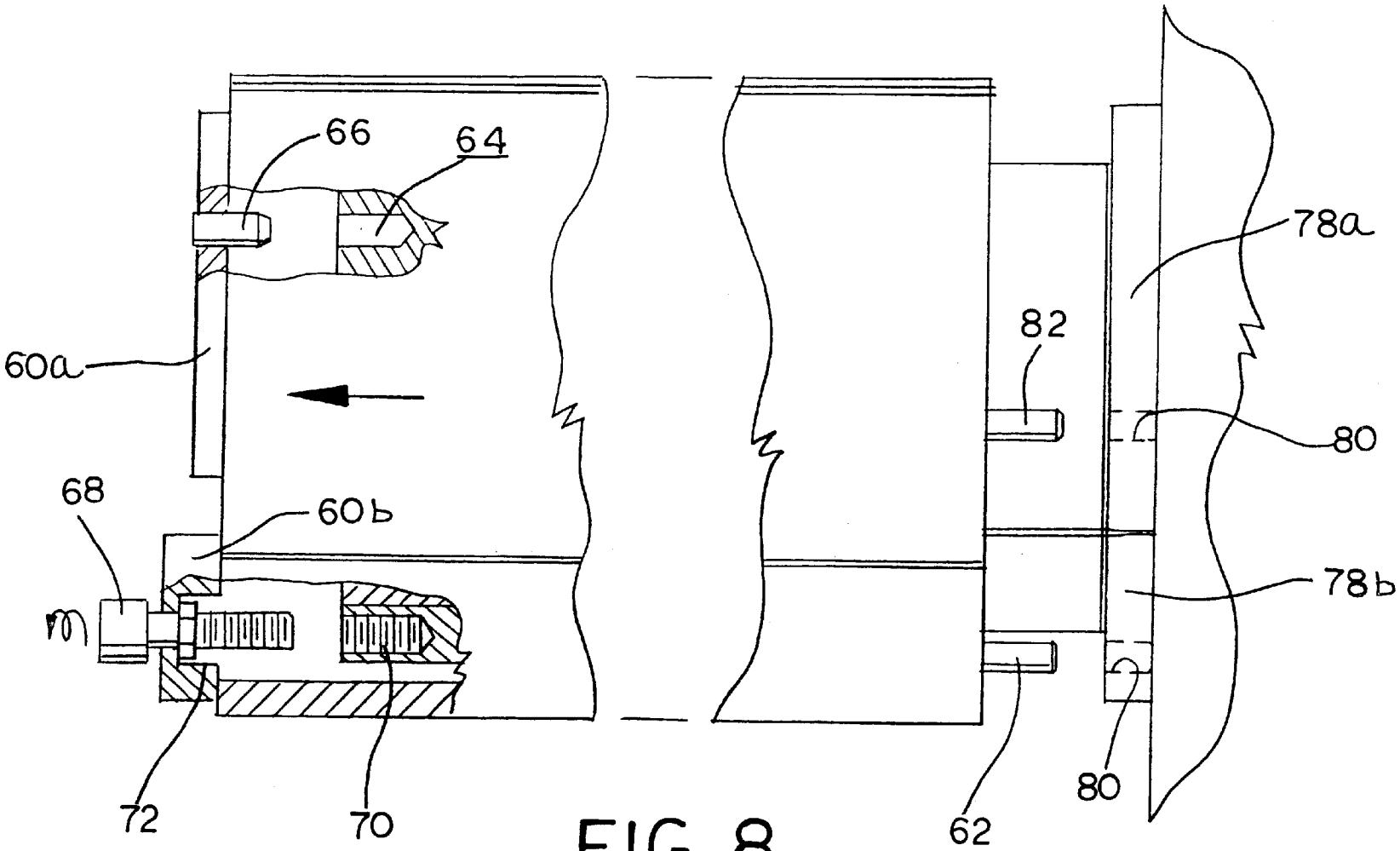
FIG. 8 is a view similar to FIG. 7, but illustrating the sleeve partially removed from the drum.

As shown in FIGS. 7–8, rear adapter plates 78*a*, 78*b*, 78*c* project radially outwardly from each of the arcuate drum segments 40*a*–40*c* at the end thereof adjacent the fixed support 18. Each of the rear adapter plates 78*a*, 78*b*, 78*c* are provided with apertures 80 which are adapted to receive pins 82 projecting from the end of each of the sleeve segments 54*a*–54*c*. Accordingly, each of the pins 82, 64 and the jack bolt 68 assure that the sleeve segments 54*a*–54*c* expand and contract with the drum segments 40*a*–40*c*, the pins and jack bolt permitting slight pivoting between the sleeve segments and the drum segments to accommodate the expansion and retraction. Furthermore, the pins 82, 66 and jack bolt 68 also assure that the sleeve 38 rotates with the drum 26.

Figure 2:
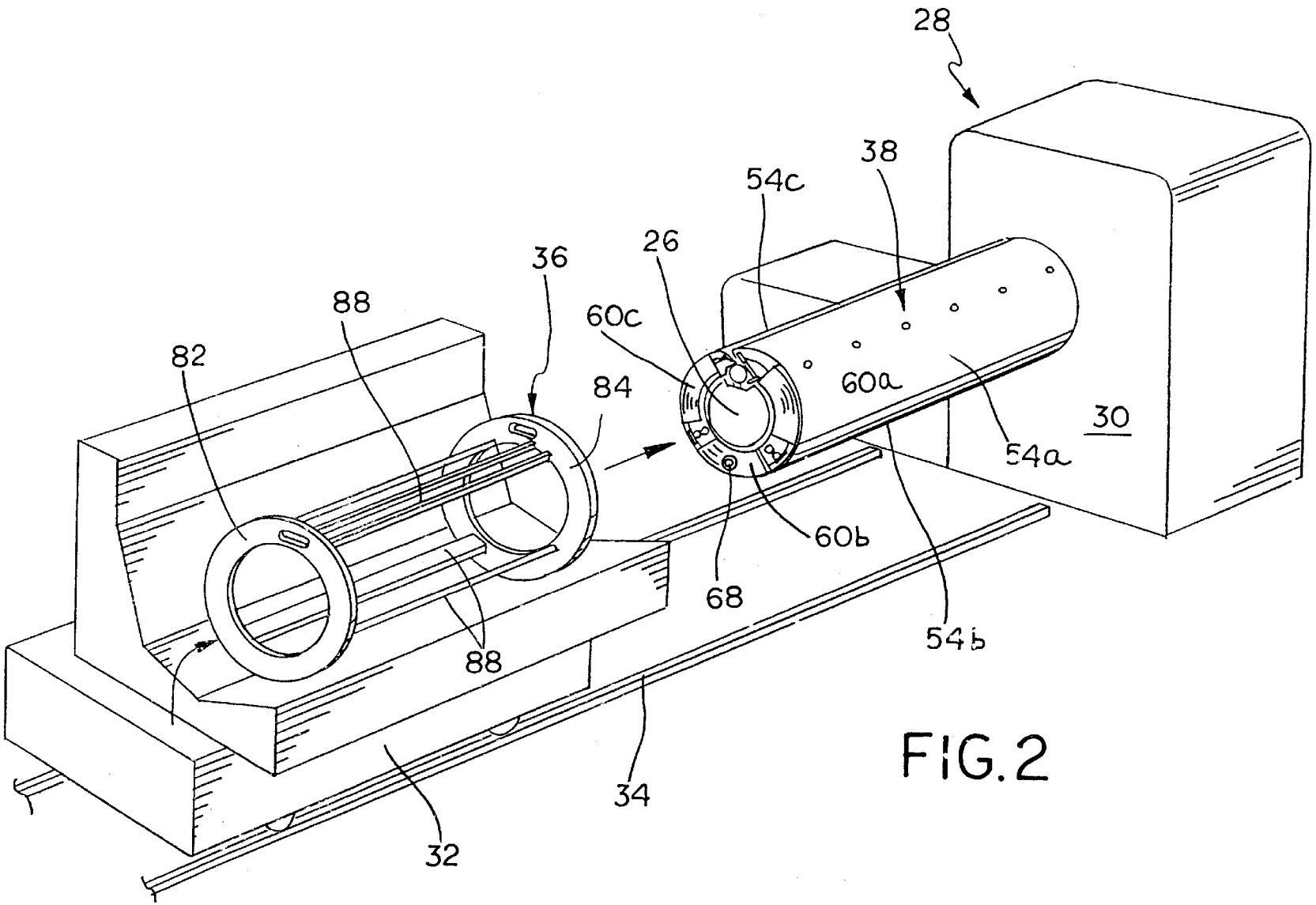
FIG. 2 is a view in perspective of the recoiler, coil cart, sleeve and cradle of the present invention illustrating the manner in which the cradle is transported to the recoiler for removal of the sleeve.
Figure 3:
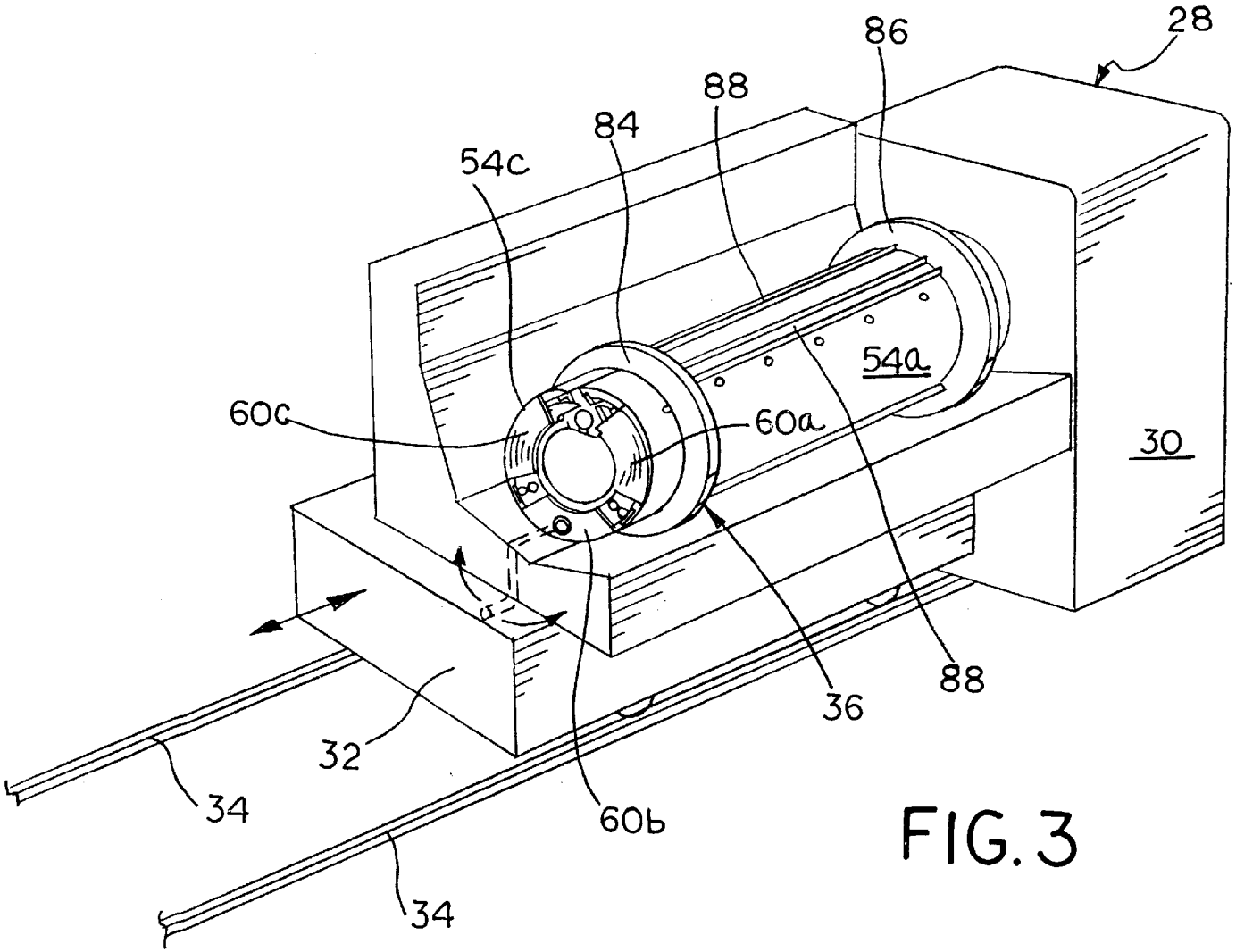
FIG. 3 is a view in perspective illustrating the cradle engaged with the sleeve while the sleeve remains mounted on the recoiler drum.

During installation and removal of the sleeve 38 on the drum 26, the sleeve is supported in the cradle 36, as shown in FIGS. 3–5. Cradle 36 includes axially separated, circumferentially extending members 84, 86 which circumscribe the sleeve 38 when the sleeve is supported by the cradle. Circumferentially extending members 84, 86 are interconnected by longitudinally extending struts 88. Each of the struts 88 carry longitudinally extending magnets 90 (FIG. 5), which are secured to the struts 88. The cradle 36 is supported on surfaces 92 of the cart 32, when the cradle is moved between the positions of FIGS. 2–4.

In operation, when the sleeve 38 is to be removed from the drum 26, the drum 26, with the sleeve 38 attached thereto as described above, is retracted to permit the coil cart 32 to move the cradle 36 from the FIG. 2 position, in which the cradle 36 is displaced from the drum 26, into the FIG. 3 position, in which the cradle 36 is moved over the sleeve 38 with the circumferentially extending members 84, 86 of the cradle 36 circumscribing the outer circumference of the sleeve 38. The drum 26 is then expanded into the expanded position, in which the outer circumference of the sleeve is adjacent the struts 88. An appropriate tool (FIG. 3) is then applied to the jack bolt 68, which is turned in the direction to advance the jack bolt 68 out of the cavity 72. Accordingly, the shoulder 74 first engages the shoulder 76, and further rotation of the jack bolt 68 then draws the sleeve 38 outwardly relative to the drum 26 away from the fixed support 18. It will be noted that the length of the threaded section of the jack bolt 68 within the cavity 70 is longer than the length of the pins 66, 82 within their corresponding apertures 80. Accordingly, before the jack bolt 68 is fully backed out of the threaded aperture 70, the sleeve 38 will have been pulled axially to a distance sufficient to withdraw the pin 64, 82 from their corresponding apertures. The magnets 90 on the struts 88 then expand the sleeve relative to the drum a small distance, the sleeve then being free of the drum. The coil cart 32 is then used to move the cradle 36 with the sleeve 38 to the FIG. 4 position. Accordingly, the cradle with the sleeve supported therein may be lifted off of the coil cart 32 by a crane, to permit feeding a new coil 14 at the uncoiler for a new cycle.

When the sleeve 38 is to be reinstalled on the drum 26, the drum segments 40*a*–40*c* are contracted to permit the coil cart to transport the sleeve 38, which is supported in its expanded condition by the magnets on the struts 88 of the cradle 36, over the drum 26. The drum is then expanded, to permit alignment of the pins 64, 82 with their corresponding apertures 66, 80. The sleeve is transferred to a position in which the end of the jack bolt 64 is engaged with the aperture 70. The bolt is then cranked in the clockwise direction, thereby threadably engaging the threaded portion of the jack bolt 68 into the threaded aperture 70, to thereby urge the sleeve 38 axially relative to the drum 26 toward the fixed support 30. Accordingly, the pins 64 are installed in the aperture 66 and the pins 82 are installed in the apertures 80. The drum, with the sleeve 38 secured thereto, is then retracted, to permit removal of the cradle 36 by movement of the coil cart back to the FIG. 2 position.

With respect now to FIGS. 9 through 13, the invention will be described in relation to an adapter for use with the uncoiler 12 as viewed in FIG. 1. With respect first to FIG.

Figure 9:
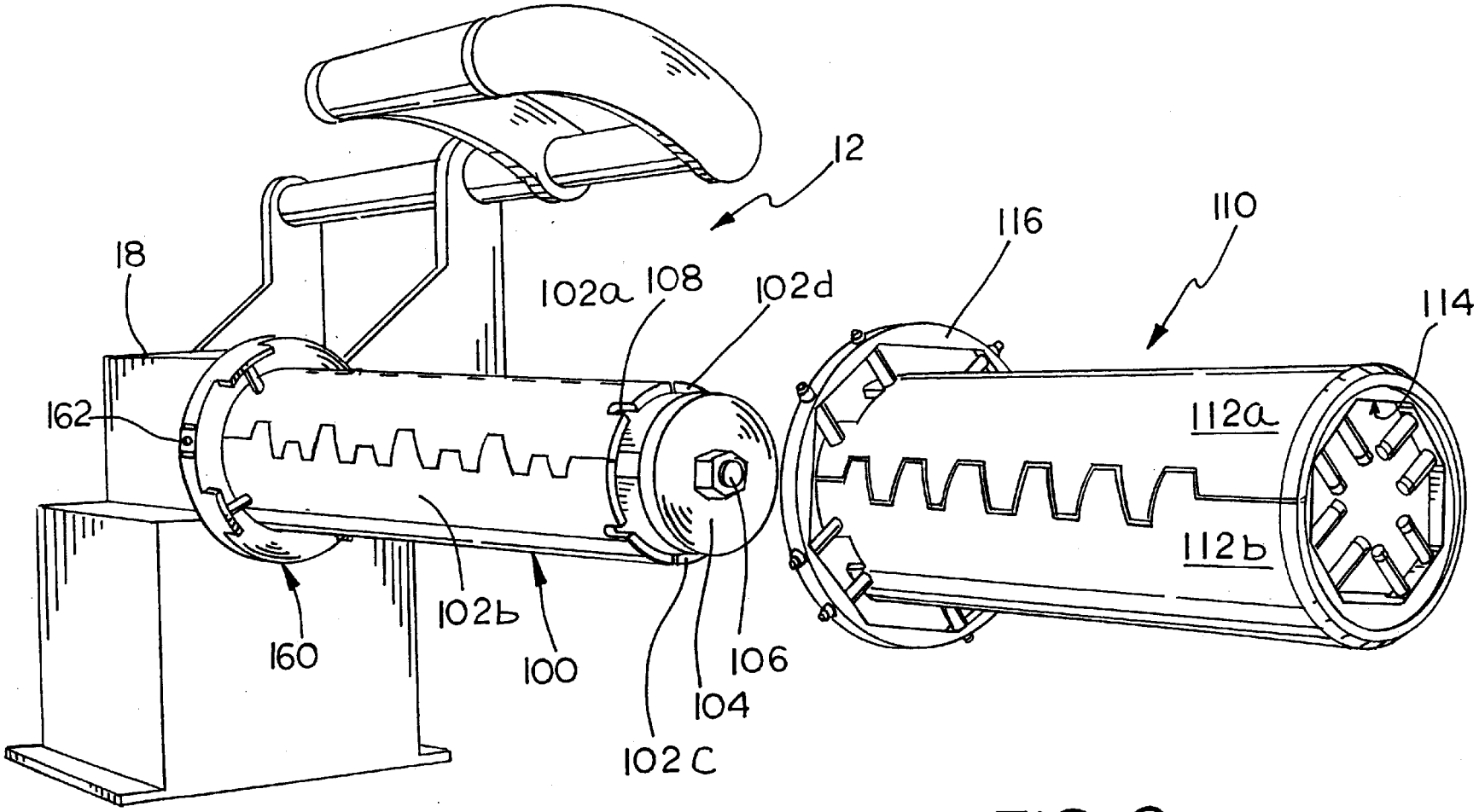
FIG. 9 is a view in perspective showing the invention in the application of an uncoiler, with the adapter sleeve poised for receipt over the uncoiler mandrel.
Figure 10:
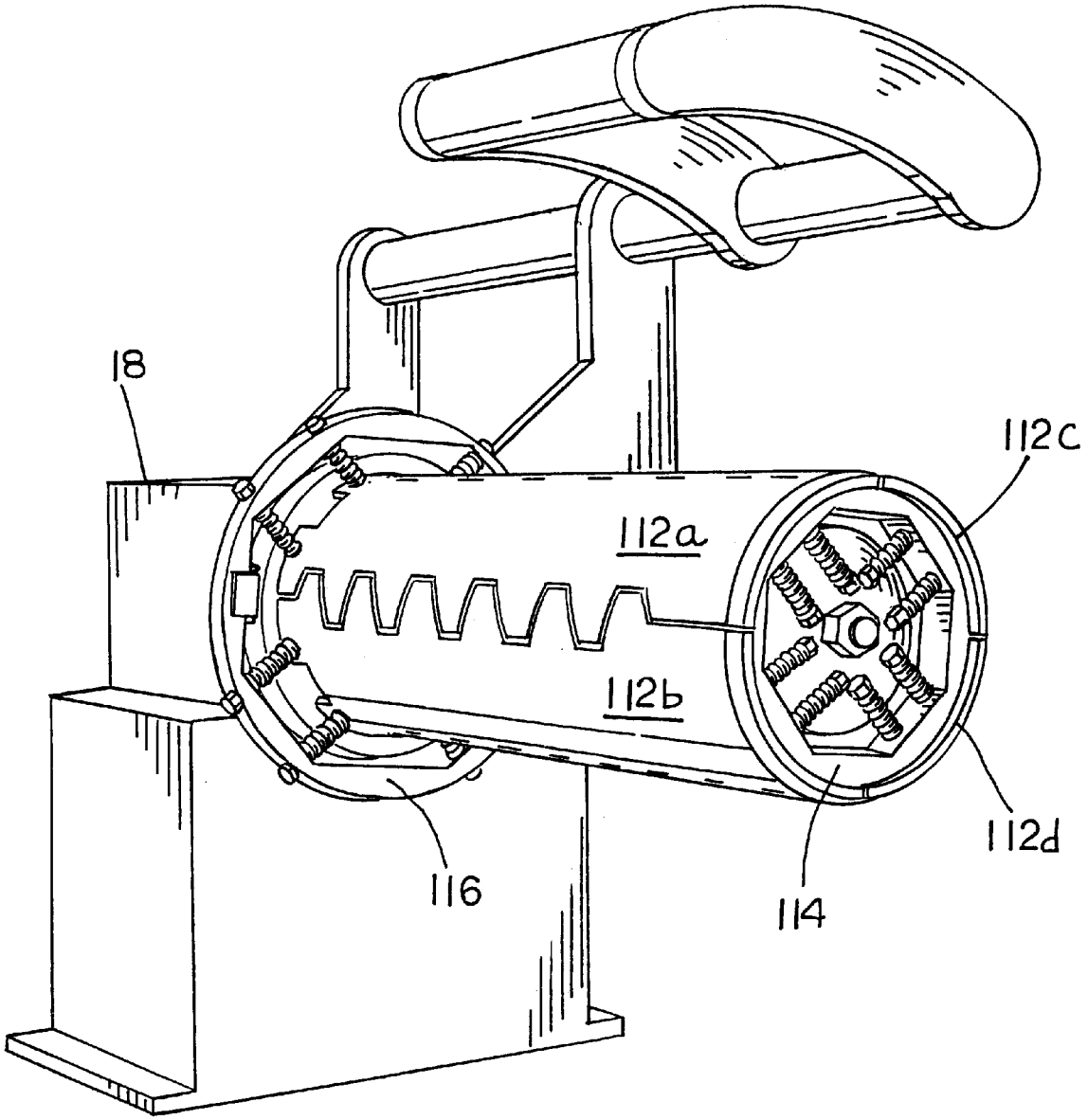
FIG. 10 is a view similar to that of FIG. 9 showing the adapter sleeve in the operating position over the uncoiler mandrel.
Figure 11:
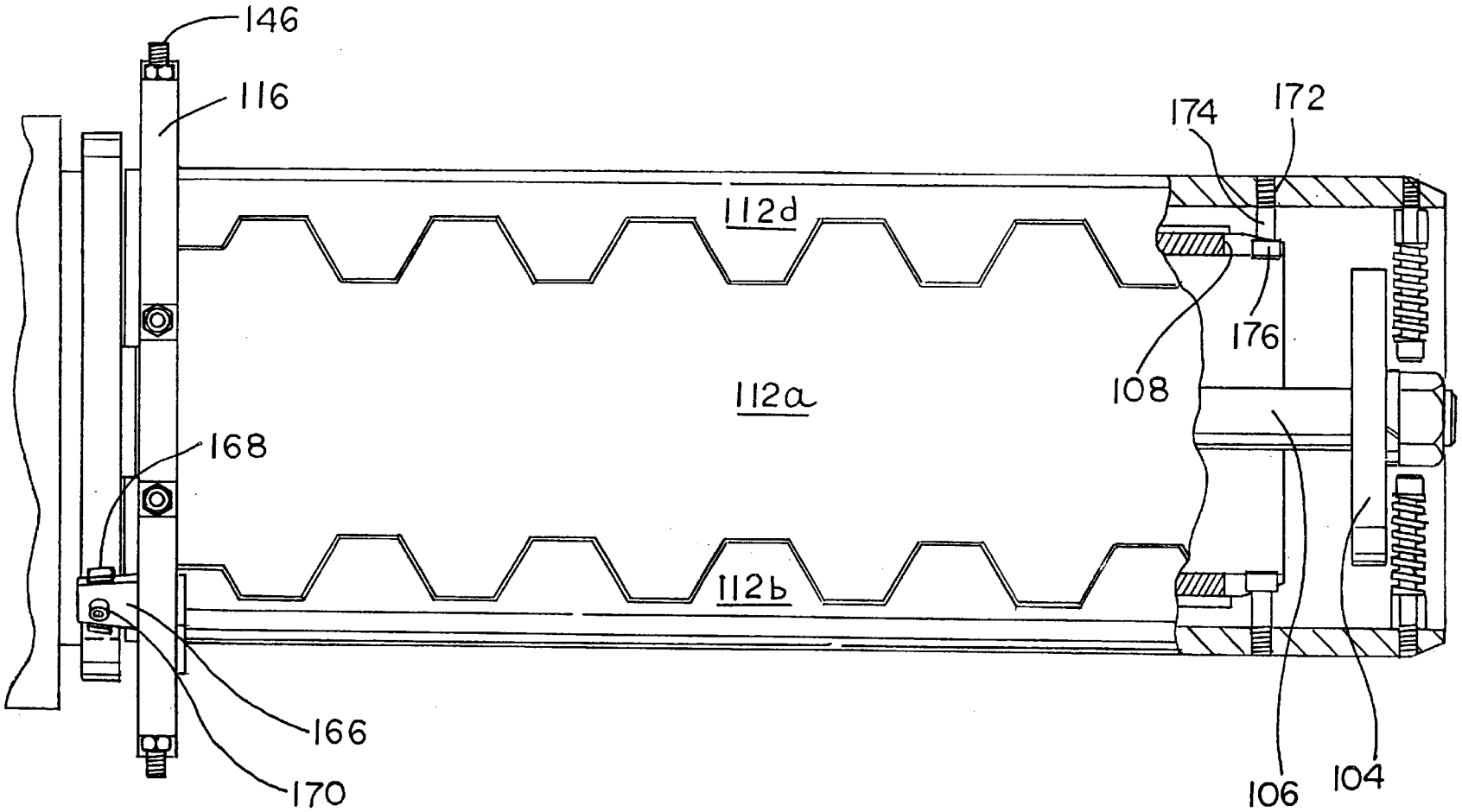
FIG. 11 is an upper plan view showing the adapter sleeve mounted to the mandrel, with the end of the sleeve partially broken away through lines 11—11 of FIG. 12 showing the connection to the mandrel.

9, the uncoiler 12 includes a drum or mandrel 100 supported on fixed support member 18 where the mandrel includes a plurality of arcuate segments 102*a* through 102*d*. Each of these segments is radially expandable through the contraction of plate 104 and rod 106, see FIGS. 9 and 11. As also shown in FIG. 9, the free end of each segment 102*a*–102*d* includes receiving slots 108 as will be described in further detail. With respect now to FIG. 9, the expansion sleeve 110 will be described in greater detail.

As shown in FIG. 9, the expansion sleeve 110 is comprised of a like plurality of arcuate segments 112*a*–112*d*, which overlie respective arcuate segments 102*a*–102*d* of the mandrel. The arcuate segments 112*a*–112*d* are held in a cylindrical fashion by expansion rings 114 and 116 as shown best in FIG. 13. Expansion ring 114 includes an outer peripheral surface 118 and an inner diameter 120 characterized by a plurality of tangential surfaces 122*a*–122*d*. As shown in FIG. 13, each of the tangential surfaces 122*a*–122*d* is radially aligned with the arcuate segments 112*a*–112*d*, respectively. As also shown in FIG. 13, the arcuate segments 112*a*–112*d* are attached to the retaining ring 114 by way of bolts 126 slidably movable within apertures 128 and which are threadably received in threaded aperture 130. It should be appreciated that a compression spring 132 is trapped between the tangential surface 122*a* and the head 134 of the bolt 126, which spring loads the arcuate segments in the normally retracted position. As the apertures 128 are perpendicular relative to the tangential surface 122*a*, the outward movement of the segment 112*a* is along a radial line, as shown by a comparison of FIGS. 12 and 13.

Figure 12:
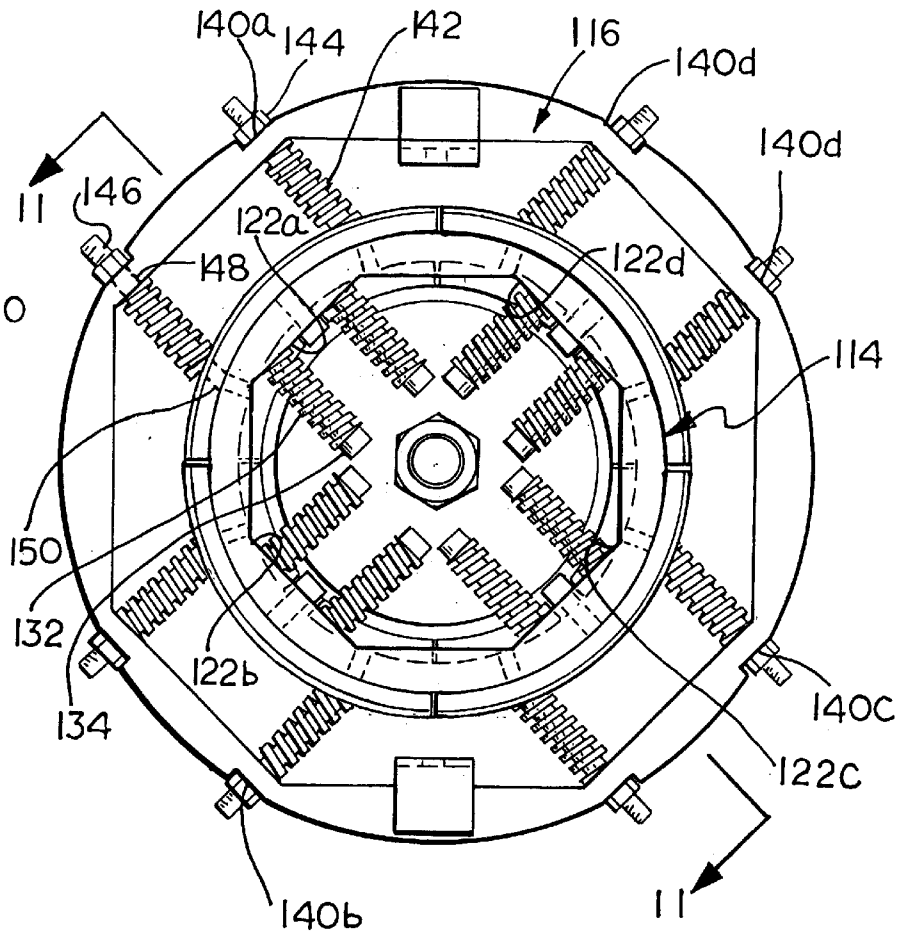
FIG. 12 is an end view of the sleeve over the mandrel in the unactivated condition.
Figure 13:
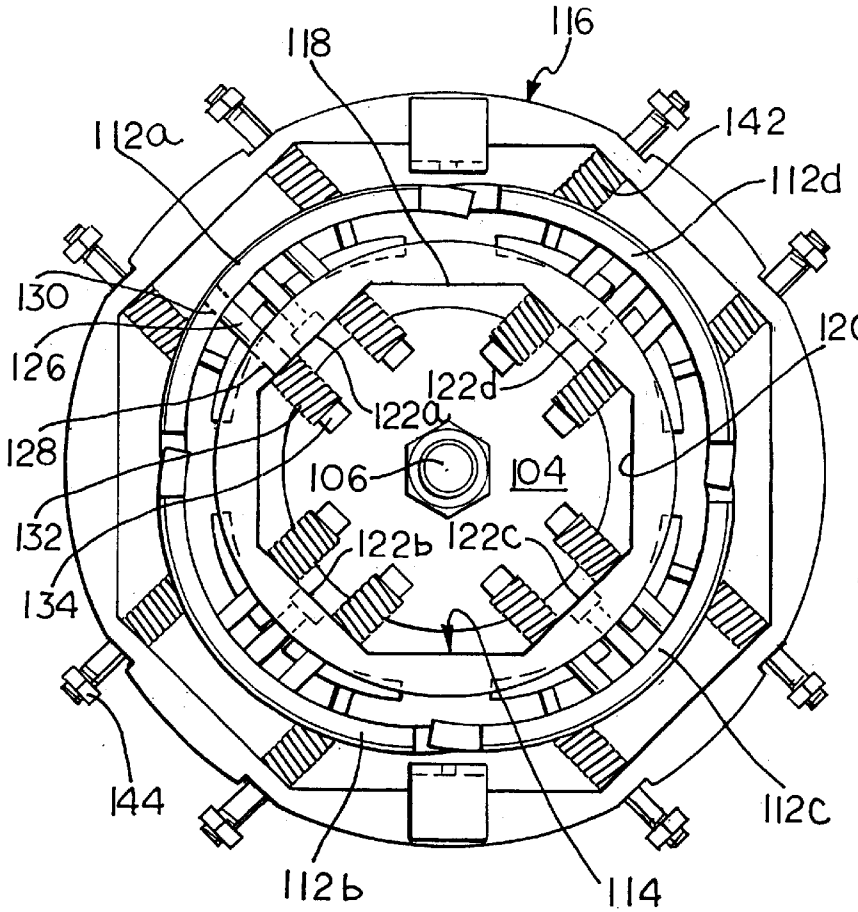
FIG. 13 is similar to FIG. 12, showing the sleeve and mandrel when activated.

In a like manner, the arcuate segments 112*a*–112*d* are spring loadably retained to the rear retaining ring 116 by way of an assembly of compression spring nuts 142, 144, and studs 146, which pass through clearance apertures 148 and are threadably engaged in threaded apertures 150, as shown best in FIGS. 12 and 13. Lock nuts 144 are secured against the retaining ring 116 and against tangential surfaces 140*a* to secure the assembly together. In a similar manner to tangential surfaces 122*a*–122*d*, the tangential surfaces 140*a*–140*d* also have a clearance aperture 148 which is perpendicular thereto, such that studs 146 move radially, together with and upon the expansion of the arcuate sections 11 2*a*–112*d*.

In this manner, not only are the arcuate sections 112*a*–112*d* movable relative to their respective retaining rings 114 and 116, but the sleeve assembly 110 is self-contained, and can be retained together in an assembly. To mount the sleeve assembly 110 over the mandrel 100, the sleeve assembly 110 is slidably received over the mandrel as discussed relative to FIGS. 1 through 8, whereupon the sleeve assembly 110 is fixed to the uncoiler 12. In this regard, the uncoiler 12 includes a rear flange 160 including along its outer periphery a plurality of mounting apertures 162 (only one of which can be viewed in FIG. 9). As viewed in FIG. 11, the inner side of the retaining ring 116 includes a mounting bracket 166 which is slidably receivable between mounting guides 168 whereupon a capscrew such as 170 can be threadably engaged to secure a retaining ring 116 and associated arcuate sections 112*a*–112*d* to the uncoiler 12. On the front side thereof, and still with respect to FIG. 11, the arcuate sleeves include threaded apertures at 172 for receiving capscrews 174 whereupon the head 176 of the capscrew can be slidably received within the slots 108, for alignment of the sleeve 110 with the mandrel 100.

Advantageously, in both instances, that is, with both the uncoiler 12 and the recoiler 28, the sleeves 38 and 110 are stand-alone assemblies which can be stored in an assembled manner and be removed from the mandrels as a unit. As such, the sleeves can be easily applied to their respective mandrels and easily fixed thereto. As mentioned above, it is common to change over the coil diameter sizes between three to four times per day, and it has been found that, using the sleeve assembly in accordance with the invention, the changeover time for each change can be reduced by one-half hour, by using the coilers of the present invention.

What is claimed is:

1. Coiler for use in a line for processing sheet material comprising a fixed support, a rotatable, segmented drum mounted on said fixed support for rotation relative thereto, said drum being divided into multiple interconnected drum segments, an expander for moving said segments between an expanded position and a retracted position wherein the diameter of the drum is less than the diameter of the drum in the expanded position, and a sleeve assembly circumscribing said drum, said sleeve assembly being comprised of a subassembly of multiple interconnected sleeve segments held together for slidable receipt over said segmented drum, where each said sleeve segment corresponds with the drum segments whereby the sleeve segments are movable with the drum segments between the expanded and retracted positions.

2. Coiler as claimed in claim 1, further comprising retaining means for retaining the sleeve segments in juxtaposition for slidable receipt over said segmented drum.

3. Coiler as claimed in claim 2, wherein said retaining means is comprised of forward and rearward retaining rings, and retaining elements which retain the sleeve segments in position to said retaining rings.

4. Coiler as claimed in claim 3, wherein said retaining means further comprises hinge members joining sleeve segments together, adjacent to at least some of their axial edges.

5. Coiler as claimed in claim 4, wherein said retaining rings circumscribe said sleeve segments and said retaining elements are comprised of magnets extending between said forward and rearward retaining rings to contact exterior surfaces of said sleeve segments.

6. Coiler as claimed in claim 3, wherein said retaining elements are comprised of spring elements operatively connected to said sleeve segments allowing radial movement of said sleeve segments relative to said retaining rings.

7. Coiler as claimed in claim 6, wherein said springs elements circumferentially surround fasteners which spring load said sleeve segments to said retaining rings.

8. Coiler as claimed in claim 6, wherein said rear retaining ring includes mounting brackets for mounting said sleeve assembly to said drum.

9. Coiler as claimed in claim 1, wherein said sleeve is removable from said drum, and a cart for transporting said sleeve between an active position on said drum and an inactive position displaced from said drum.

10. Coiler as claimed in claim 9, wherein said material is processed during movement along a material pass line, said drum being in the material pass line, said cart being movable transverse to the material pass line to move said sleeve between said active position in the material pass line and said inactive position displaced transversely from the material pass line.

11. Coiler as claimed in claim 10, wherein a cradle is mounted on said cart for supporting said sleeve during transport between the active and inactive positions.

12. Coiler as claimed in claim 11, wherein said cradle includes circumferentially extending members circumscribing said sleeve when the sleeve is supported by said cradle and axially extending members interconnecting said circumferentially extending members.

13. Coiler as claimed in claim 12, wherein releasable fasteners secure said sleeve to the drum when the sleeve is installed on the drum, said axially extending members carrying magnets supporting the segments of the sleeve in a radially outward position with respect to the drum when the fasteners are released to support the sleeve on the cradle.

14. Coiler as claimed in claim 13, wherein said drum includes an attached end mounted on said fixed support and an opposite free end, each of said sleeve segments including radially inwardly extending adaptor plates extending parallel to said free end when the sleeve is mounted on the drum, said fasteners securing said sleeve segments to corresponding drum segments to thereby secure the sleeve for rotation with the drum and for radial movement with the drum segments during expansion and contraction of the drum.

15. Coiler as claimed in claim 14, wherein said fasteners include axially extending pins extending axially with respect to said sleeve and corresponding apertures in the drum for receiving said pins, and a jack bolt mounted on one of said sleeve segments and threadedly engaging a corresponding opening in one of said drum segments.

16. Coiler as claimed in claim 14, wherein each of said drum segments include drum adapter plates extending radially outwardly from said drum segments at the attachment end of the drum, said fasteners including axially extending pins extending from said sleeve segments and engaging corresponding apertures in the drum adapter plates when the sleeve is installed on the drum.

17. Coiler as claimed in claim 1, wherein a cradle is movable between a first position engaging said sleeve when the sleeve is mounted on the drum and a second position displaced from said drum, said cradle being moveable relative to said sleeve for engagement with the sleeve when the sleeve is in an active position mounted on said drum, said sleeve being movable with the cradle to an inactive position displaced from said drum and from said inactive position to said active position.

18. Coiler as claimed in claim 1, wherein said drum includes an attached end mounted on said fixed support and an opposite free end, each of said sleeve segments including radially inwardly extending adaptor plates extending parallel to said free end when the sleeve is mounted on the drum, and fasteners securing said sleeve segments to corresponding drum segments to thereby secure the sleeve for rotation with the drum and for radial movement with the drum segments during expansion and contraction of the drum.

19. Coiler as claimed in claim 18, wherein said fasteners include axially extending pins extending axially with respect to said sleeve and corresponding apertures in the drum for receiving said pins, and a jack bolt mounted on one of said sleeve segments and threadedly engaging a corresponding opening in one of said drum segments.

20. Coiler as claimed in claim 18, wherein each of said drum segments include drum adapter plates extending radially outwardly from said drum segments at the attachment end of the drum, said fasteners including axially extending pins extending from said sleeve segments and engaging corresponding apertures in the drum adapter plates when the sleeve is installed on the drum.

21. Coiler for use in a line for processing sheet material movable along a material pass line comprising a fixed support, a rotatable, segmented drum mounted on said fixed support in said material pass line for rotation relative thereto, said drum being divided into multiple pivotably interconnected drum segments, an expander for moving said segments between an expanded position and a retracted position wherein the diameter of the drum is less than the diameter of the drum in the expanded position, and a removable sleeve circumscribing said drum for increasing the diameter of the drum in the expanded position, a cradle moveable between a first position in said material pass line and a second position displaced from the material pass line for supporting said sleeve for movement between an active position on said drum and an inactive position separated from said drum and displaced from the material pass line, said cradle including circumferentially extending members circumscribing said sleeve when the sleeve is supported by said cradle and axially extending members interconnecting said circumferentially extending members.

22. Coiler as claimed in claim 21, wherein releasable fasteners secure said sleeve to the drum when the sleeve is installed on the drum, said axially extending members carrying magnets supporting the segments of the sleeve in a radially outward position with respect to the drum when the fasteners are released to support the sleeve on the cradle.

* * * * *